United States Patent [19]

Aoki

[11] Patent Number: 4,578,633

[45] Date of Patent: Mar. 25, 1986

[54] CONSTANT CURRENT SOURCE CIRCUIT

[75] Inventor: Hidehiko Aoki, Fujisawa, Japan

[73] Assignee: Kabushiki Kaisha Toshiba, Japan

[21] Appl. No.: 646,105

[22] Filed: Aug. 31, 1984

[30] Foreign Application Priority Data

Aug. 31, 1983 [JP] Japan ..... 58-159264
Aug. 31, 1983 [JP] Japan ..... 58-159301

[51] Int. Cl.[4] ..... G05F 3/26

[52] U.S. Cl. ..... 323/315; 323/273; 323/303

[58] Field of Search ..... 323/311, 312, 315–317, 323/303, 273; 330/288

[56] References Cited

U.S. PATENT DOCUMENTS

| | | | |
|---|---|---|---|
| 3,629,691 | 12/1971 | Wheatley, Jr. | 323/1 |
| 3,659,121 | 11/1972 | Frederiksen | 307/296 R |
| 3,831,040 | 8/1974 | Nanba | 323/315 |
| 3,922,596 | 11/1975 | Cave et al. . | |
| 4,029,974 | 6/1977 | Brokaw | 307/296 R |
| 4,085,359 | 4/1978 | Ahmed | 323/2 |
| 4,435,678 | 3/1984 | Joseph et al. | 323/315 |

FOREIGN PATENT DOCUMENTS

| | | | |
|---|---|---|---|
| 2157610 | 6/1973 | France . | |
| 68946 | 6/1977 | Japan | 323/315 |
| 34794 | 3/1980 | Japan | 323/316 |
| 203114 | 12/1982 | Japan | 323/315 |
| 66128 | 4/1983 | Japan | 323/315 |
| 82321 | 5/1983 | Japan | 323/315 |

OTHER PUBLICATIONS

Carsalade et al, "Automatic DC Current Regulator Circuit", IBM Tech. Discl. Bul., vol. 23, No. 7A, pp. 2850, 2851, Dec. '80.

Patent Abstracts of Japan, vol. 7, No. 156 (P-209) [1301], 8th Jul. 1983.

Patent Abstracts of Japan, vol. 7, No. 57 (P-181) [1202], 9th Mar. 1983.

Electronics; Apr. 28, 1969; pp. 139–141.

*Primary Examiner*—William H. Beha, Jr.

*Attorney, Agent, or Firm*—Finnegan, Henderson, Farabow, Garrett & Dunner

[57] ABSTRACT

A circuit produces a stable constant current during power source voltage fluctuations which includes resistance means and first, second, third, fourth, fifth and sixth transistor devices. The first and second transistor devices are of a first conductivity type and are connected to form a first current mirror circuit, the first transistor device being connected as a diode. The third and fourth transistor devices are of a second conductivity type and are connected to each other to form a second current mirror circuit, the third transistor device being connected in series with the second transistor device, and the fourth transistor device being connected as a diode. The fifth transistor device is connected at its collector-emitter path in series with the first transistor device and at its base to the connection point between the second and third transistor devices. The resistance means is connected between the first and fifth transistor devices. The sixth transistor device is connected at its collector-emitter path in series with the fourth transistor device and at its base electrode to the connection point between the fifth transistor device and the resistance means.

12 Claims, 6 Drawing Figures

CONSTANT CURRENT SOURCE CIRCUIT

BACKGROUND OF THE INVENTION

This invention relates to a constant current source circuit, and more particularly, to a semiconductor current source circuit adapted for providing an electrical current with a constant current characteristic substantially unaffected by a change in bias voltage.

DESCRIPTION OF THE PRIOR ART

Constant current source circuits are very useful in integrated circuit (IC) design. Many forms of constant current source circuits have been developed. The operating current of such a constant current circuit, which is powered by a power source voltage, should not change with variation in the power source voltage.

Also, it is advantageous that the circuit be able to operate at a low power source voltage and with low power consumption.

Some of the IC constant current source circuits which have frequently been used are faulty in that the output current is susceptible to variation of the circuit's power source voltage. Also, the circuits require a relatively high power source voltage and dissipate a relatively high amount of power.

Two examples of conventional constant current source circuits are shown in FIGS. 1 and 2 and are more fully discussed below.

SUMMARY OF THE INVENTION

The subject invention relates to a novel constant current source circuit for producing a stable current substantially uninfluenced by fluctuations in power source voltage and which can operate at a low power source voltage and with low power consumption.

These and other objects are achieved in the constant current source circuit of the invention which includes first and second transistor devices of a first conductivity type connected to form a first current mirror circuit, the first transistor device being connected in a diode fashion; third and fourth transistor devices of a second conductivity type connected to form a second current mirror circuit, the third transistor device being connected in series with the second transistor device, and the fourth transistor device being connected in a diode fashion; a fifth transistor device connected at its collector-emitter path in series with the first transistor device and at its base electrode to the connection point between the second and third transistor devices; a resistor connected between the first and fifth transistor devices; and a sixth transistor device connected at its collector-emitter path in series with the fourth transistor device and at its base electrode to the connection point between the fifth transistor device and the resistor.

The output current of the present invention is automatically controlled to coincide with a predetermined constant current through a negative feedback loop comprised of the sixth transistor, the second current mirror circuit, and the fifth transistor device.

Accordingly, an object of the present invention is to provide a constant current source circuit which produces a stable current substantially uninfluenced by variations in its power source voltage.

A further object of the present invention is to provide a constant current source circuit which can be operated at a low power source voltage and with low power consumption.

Additional objects, advantages, and features of the present invention will further become apparent to persons skilled in the art from a study of the following description and of the accompanying drawings.

DESCRIPTION OF THE PREFERRED EMBODIMENT

Figure 1:
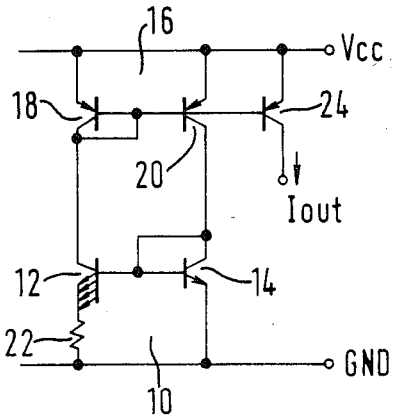
FIG. 1. PRIOR ART
FIG. 1 is a circuit diagram of a prior art constant current source circuit relating to the field of the invention.

The present invention will now be described in detail with reference to the accompanying drawings, i.e., FIG. 1 to FIG. 6. Throughout the drawings, like reference numerals and letters are used to designate like or equivalent elements for the sake of simplicity of explanation.

Referring now to FIG. 1, a conventional constant current source circuit is shown. The constant current source circuit is provided with a current mirror 10 which is comprised of transistors 12 and 14, the current gain of which depends primarily on the collector currents thereof, and a current mirror 16 which is comprised of transistors 18 and 20, the current gain of which is about one (1) independent of the magnitudes of the collector currents of transistors 18 and 20. Another circuit of this type is disclosed in U.S. Pat. No. 3,629,691.

The circuit of FIG. 1 operates as follows. Over a small current range the voltage drop across resistor 22, which is inserted in the emitter circuit of transistor 12, is negligible. Transistor 12 has a large base-emitter junction area, and the current gain is proportional to the ratio between the base-emitter junction areas of transistors 12 and 14. In this example, the base-emitter junction area ratio is N:1, where $N>1$. Accordingly, a positive feedback loop with a loop gain of about N is formed so that the current of transistors 12 and 14 increases rapidly. When the current reaches a predetermined value I the current suppressive effect (current feedback of resistor 22) settles the loop gain at one (1) with the result that the circuit becomes stable. In this situation, the following relationship holds:

$$I_o=(V_T/R_{22})\times \ln(N)$$

where $V_T=kT/q$, T is absolute temperature, k is Boltzmann's constant, q is the electric charge of an electron, and $R_{22}$ is the resistance value of resistor 22.

The value of current $I_o$ is assumed under the ideal condition where the current amplification factor $\beta$ of each transistor is infinite and the decrease of the current amplification factor as a result of the Early effect of a transistor is not considered. In fact, however, when the output current $I_{out}$ is derived at transistor 24, the sum of the base currents of transistors 18, 20 and 24 flows into the collector of transistor 12. Accordingly, the operating currents of transistors 12 and 14 are unbalanced depending on the current amplification factors of transistors 18, 20 and 24. PNP transistors such as transistors 18, 20 and 24 are generally fabricated to be of lateral structure with low current amplification factors, i.e., approximately 10 to 40, and with large variations of $\beta$. This tendency is greater as the output current $I_{out}$ becomes larger. Accordingly, this restricts the maximum output current of the device.

The collector-to-emitter voltages $V_{CE}$ of the pairs of transistors 12 and 14, and 18 and 20, which constitute the current mirrors, are different from one another and the magnitudes of voltages depend on the power source voltage $V_{cc}$. Therefore, the magnitude of the output current $I_{out}$ is affected by the power source voltage $V_{cc}$ when the Early effect is present by the appearance of the ripple component of the power source voltage $V_{cc}$ in the output current $I_{out}$.

Figure 2:
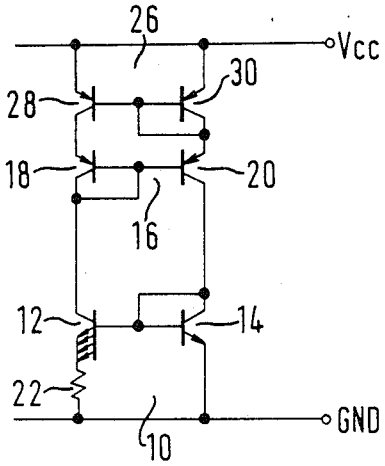
FIG. 2. PRIOR ART
FIG. 2 is a circuit diagram of another prior art constant current source circuit relating to the field of the invention.

Referring now to FIG. 2, there is shown another conventional constant current source circuit which is an improvement for the circuit of FIG. 1. The circuit of FIG. 2 differs from that of FIG. 1 in that there is connected a further current mirror 26 comprised of transistors 28 and 30 between current mirror 16 and power source $V_{cc}$.

Current mirror 26 operates to balance the collector-to-emitter voltages of PNP transistors 18 and 20 of current mirror 16. Accordingly the unbalance of the amplification factors of transistors 18 and 20 and the difference between base currents of transistors 12 and 14 of current mirror 10 is reduced. Therefore, the constant current source circuit of FIG. 2 has stable output current characteristics compared to the FIG. 1 circuit.

However, the circuit of FIG. 2 has the disadvantage that it requires a higher power source voltage and therefore requires more power than the circuit of FIG. 1. This is because the current source circuit of FIG. 2 has three transistors in series in any path between power source $V_{cc}$ and reference potential source GND.

Figure 3:
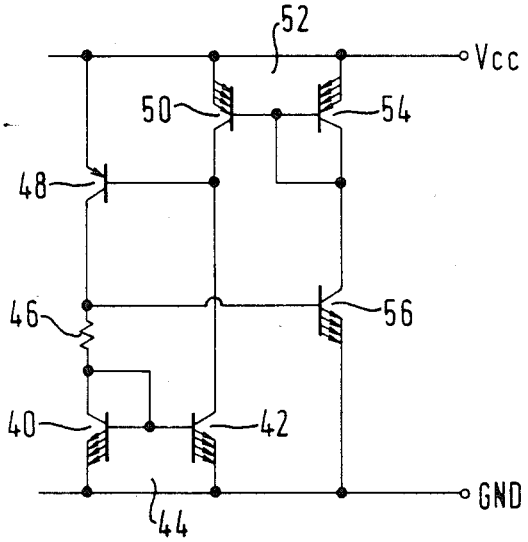
FIG. 3 is a circuit diagram of a preferred embodiment of the constant current source circuit according to the present invention.

Referring now to FIG. 3, there is shown a preferred embodiment of a constant current source circuit according to the present invention. In FIG. 3, first and second NPN transistors 40 and 42 are connected to form a current mirror circuit 44. Third and fourth PNP transistors 50 and 54 are connected to form another current mirror circuit 52. Transistor 40 is connected as a diode, with the collector connected to its base and its emitter is connected to reference potential source GND and its collector to power source $V_{cc}$ via resistor 46 and fifth PNP transistor 48. Transistor 42 of current mirror circuit 44 is connected at its emitter to reference potential source GND and at its collector to power source $V_{cc}$ via PNP transistor 50. The base of transistor 48 is connected to the collector of transistor 50. PNP transistor 54 is connected as a diode having the collector connected to its base. Transistor 54 is connected at its emitter to power source $V_{cc}$ and at its collector to reference potential source GND via sixth NPN transistor 56 whose base is connected to the collector of transistor 48.

It is assumed that transistor 48 has a base-emitter junction of unit area and transistors 40, 42, 50, 54 and 56 have base-emitter junctions respectively of $N_{40}$, $N_{42}$, $N_{50}$, $N_{54}$, and $N_{56}$ times the unit area, each being greater than one. The base-emitter junction area ratios $N_{40}$, $N_{42}$, $N_{50}$, $N_{54}$ and $N_{56}$ are not necessarily integers.

Operation of the circuit shown in FIG. 3 is now explained in detail. The carrier concentration of transistors 40 and 42 is assumed to be uniform. If transistors 40 and 42 have base-emitter junctions of $N_{40}$ and $N_{42}$ times the unit area, the emitter current densities of transistors 40 and 42 are related according to the ratio $N_{40}$:$N_{42}$. The currents $I_{40}$ and $I_{42}$ of transistors 40 and 42 theoretically are stable at the value $I_o$ like the prior art circuit of FIG. 1.

$$I_O=(V_T/R_{46})\times 1n(N_{42}/N_{40})$$

where $R_{46}$ is the resistance value of resistor 46.

When the currents $I_{40}$ and $I_{42}$ of transistor 40 and 42 in current mirror 44 vary, the voltage drop $V_{46}$ across resistor 46 also varies. Transistor 56, current mirror 52, and transistor 48 comprise a negative feedback loop to stabilize the potential at the connecting point of resistor 46 and transistor 48. The potential at the connecting point, that is, a sum of the voltage drop $V_{46}$ and the base-to-emitter voltage $V_{BE}$ of transistor 40 is applied to the base of transistor 56. Variation of current $I_{40}$ or $I_{42}$ is detected by transistor 56 as a result of a change in voltage across resistor 46. Current $I_{56}$ through transistor 56 varies according to changes in its base potential. Current $I_{54}$ of transistor 54 varies accordingly because the current $I_{56}$ of transistor 56 is supplied from transistor 54. Current $I_{50}$ of the other transistor 50 of current mirror 52, which is always proportional to current $I_{54}$, varies according to the variation of current $I_{54}$. The variation of the current $I_{50}$ causes the current $I_{42}$ of transistor 42 and also the current $I_{48}$ of transistor 48 to vary. Therefore, the circuit of FIG. 3 is automatically controlled to maintain the currents of the respective transistors 40, 42, 48, 50, 54 and 56 at their predetermined values, and in particular, currents $I_{40}$ and $I_{42}$ at the value $I_o$.

If it is assumed that transistors 40, 42, 50, 54 and 56 have base-emitter junctions respectively of $N_{40}$, $N_{42}$, $N_{50}$, $N_{54}$ and $N_{56}$ times of the unit area, where the base-emitter junction area ratios $N_{40}$, $N_{42}$, $N_{50}$, $N_{54}$ and $N_{56}$ are not necessarily integers, certain relations among the respective currents $I_{40}$, $I_{42}$, $I_{48}$, $I_{50}$, $I_{54}$, and $I_{56}$ will exist. Since transistor 48 is connected in series to transistor 40, $$I_{48}=I_{40}=I$$

Since transistor 42 forms current mirror 44 with transistor 40, $$I_{42}=(N_{42}/N_{40})\times I_{40}=(N_{42}N_{40})\times I \quad (1)$$

As to currents $I_{40}$ and $I_{56}$, $$R_{46}\times I+V_T\times \ln(I_{40}/(N_{40}\times I_{s(NPN)})=V_T\times \ln(I_{56}/(N_{56}\times I_{s(NPN)}) \quad (2)$$

$$I=(V_T/R_{46})\times \ln(N_{40}\times I_{56})/(N_{56}\times I_{40})=(V_T/R_{46})\times \ln(N_{40}\times I_{56})/(N_{56}\times I)$$

As to currents $I_{54}$ and $I_{50}$, $$I_{50}=(N_{50}/N_{54})\times I_{54}=(N_{50}/N_{54})\times I_{56} \quad (3)$$

-continued $$I_{56} = (N_{54}/N_{50}) \times I_{50}$$

By substituting equation (3) into equation (2), $$I=(V_T/R_{46})\times 1n(N_{40}\times N_{54}I_{50})/(N_{56}\times N_{50}\times I) \quad (4)$$

By substituting equation (1) into equation (4) since current $I_{50}$ balances $I_{42}$, $$I = (V_T/R_{46}) \times \ln (N_{40} \times N_{54} \times (N_{42}/N_{40}) \times I)/(N_{56} \times N_{50} \times I) = (V_T/R_{46}) \times \ln (N_{42} \times N_{54})/(N_{56} \times N_{50}) \quad (5)$$

As is apparent from equation (5), current I is not affected by the ratio $N_{40}$ of transistor 40.

Further, the circuit shown in FIG. 3 has only two transistors in any path between power source $V_{cc}$ and reference potential source GND. The voltage necessary to operate any path in the circuit of FIG. 3 is lower than that required in the prior art; i.e. $(V_{BE}\times 1)+(V_{CE}\times 1)$ $(=0.7\sim 0.8$ V). Therefore, the constant current source circuit shown in FIG. 3 is able to operate at a relatively low power source voltage in comparison to that of the circuit shown in FIG. 2.

On the other hand, transistors 50 and 54 have collector-to-emitter voltages $V_{CE}$ equal to each other. Therefore, current mirror 52 is less influenced by mismatching between the Early effects of transistors 50 and 54, in spite of the fact that PNP transistors are apt to be strongly influenced by the Early effect. The same is true for the relation between transistors 42 and 56.

Transistor 56 is supplied with current $I_{54}$ of transistor 54 and the base currents of transistors 50 and 54, while transistor 42 is supplied with current I and the base current of transistor 48. Therefore, transistors 50 and 54 are not exactly balanced with each other by the value of one base current. However, in practical use, additional transistors are connected to transistor 50, as shown, e.g., in FIG. 5. Therefore transistors 42 and 56 are easily balanced in regard to base currents flowing thereinto.

Figure 4:
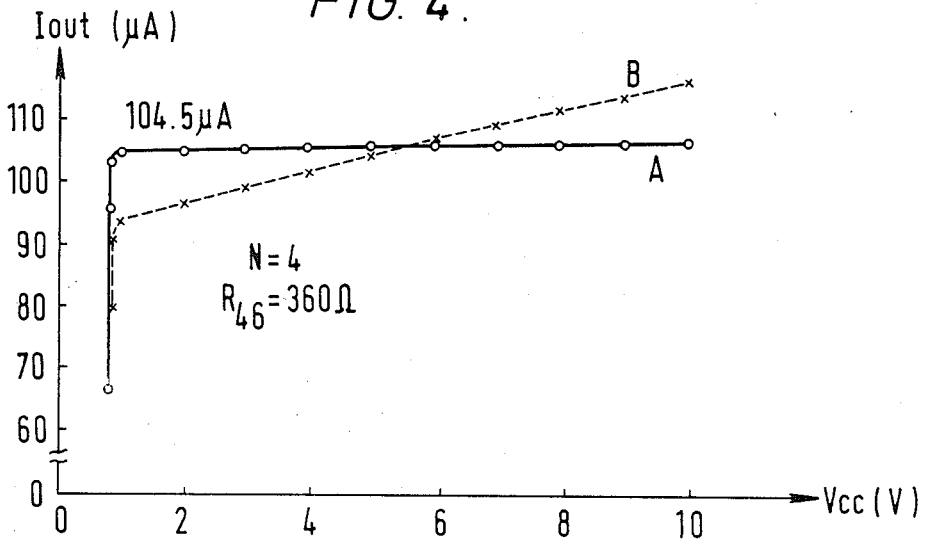
FIG. 4 is a graph illustrating the constant current characteristics of the respective circuits shown in FIGS. 1 and 3.

FIG. 4 shows output current characteristics developed by computer simulation. In FIG. 4, graph A with the solid line denotes the characteristic of the circuit of the present invention shown in FIG. 3 and is flat in a wide range of power source voltage $V_{cc}$. Graph B with the dotted line denotes the characteristic of the prior art circuit shown in FIG. 1 and increases according to increases of power source voltage $V_{cc}$. For the computer simulation, parameters were set to the following values: N=4, $R_{46}=360\Omega$ (ohms), $\beta_{(NPN)}=150$, $\beta_{(PNP)}=40$, $I_{s(NPN)}=1.9\times 10^{-16}$ A (amperes), $I_{S(PNP)}=9.2\times 10^{-16}$ A, $V_{A(NPN)}$ ($V_A$ represents Early voltage)=150 V, $V_{A(PNP)}=34$ V. (The suffixes NPN and PNP denote respectively NPN transistor and PNP transistor.)

When influences by base currents of respective transistors and the Early effects are taken into consideration, current I flowing through resistor 46 for detecting current variation is represented as follows:

$$I_{46} = \frac{V_T}{R_{46}} \times$$

-continued $$\ln\left[N \times \frac{\left(A_{NPN} - \frac{1+2/\beta_{NPN}}{A_{PNP}\times\beta_{PNP}}\right)\times\left(1+\frac{2}{\beta_{PNP}}\right)}{A_{NPN}\times\left(1+\frac{1+2/\beta_{PNP}}{A_{NPN}\times A_{PNP}\times\beta_{NPN}\times\beta_{PNP}}\right)}\right]$$

wherein $$A_{NPN} = \frac{1+\frac{V_{cc}-V_{BE}}{V_{A(NPN)}}}{1+\frac{V_{BE}}{V_{A(NPN)}}}, \quad A_{PNP} = \frac{+1+\frac{V_{cc}-V_{BE}}{V_{A(PNP)}}}{1+\frac{V_{BE}}{V_{A(PNP)}}}$$

In the above equation, the component in the parenthesis is an error component due to the influences of the base currents and the Early effect. The error component varies from 1.023 to 1.030, that is, 0.7% at the most when the power source voltage $V_{cc}$ varies from 1 V to 10 V and the parameters are as follows: $\beta_{(NPN)}=150$, $\beta_{(PNP)}=40$, $V_{A(NPM)}=150$ V, $V_{A(PNP)}=34$ V. When $\beta_{(PNP)}$ is varied from 20 to 100 while the remaining parameters are held constant at the above values, the error component varies only 1.040 to 1.007 at the most, that is, 3.3%. Furthermore, the error component can be reduced to less than the above value of 3.3% by matching the base currents of transistors 50, 54 and 56.

Figure 5:
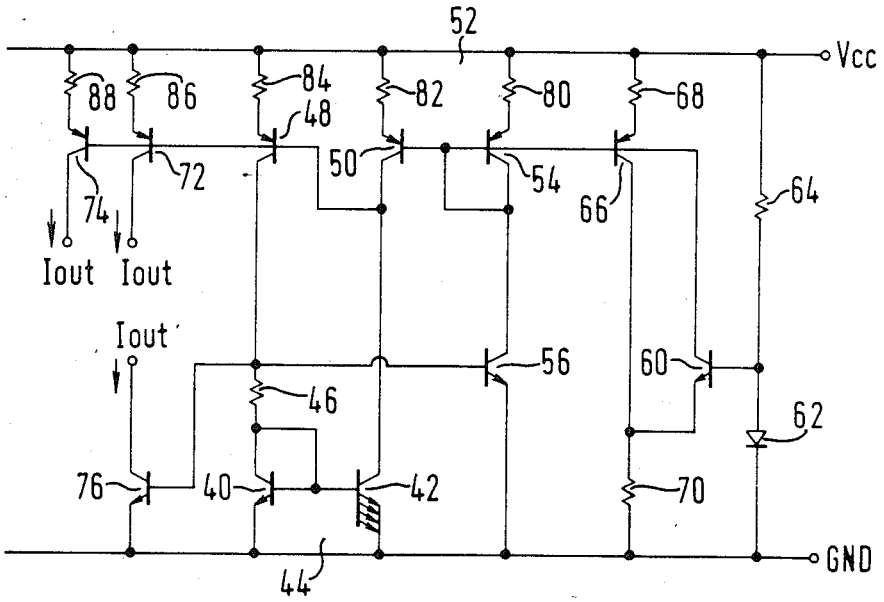
FIG. 5 is a circuit diagram of a circuit which employs a constant current source circuit according to the present invention.

FIG. 5 shows a practical circuit to which the constant current source circuit of the present invention is adapted. In FIG. 5, transistor 60, diode 62 and resistor 64 are connected as a starter circuit for the constant current source circuit. Transistor 66 and resistors 68 and 70 are connected to form a circuit which cuts off the starter circuit after the starting of the constant current source circuit has been completed. Transistors 72, 74 and 76 output the constant currents. Resistors 68, 80, 82, 84, 86 and 88, connected in series to the respective emitters of PNP transistors 66, 54, 50, 48, 72 and 74, serve to increase the Early voltage $V_{A(PNP)}$ so that the error due to the unbalance among the Early effects of PNP transistors 66, 54, 50, 48, 72 and 74 is reduced.

Figure 6:
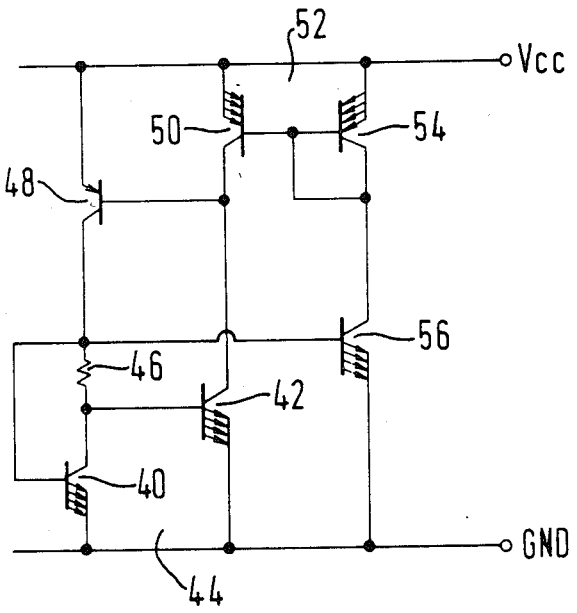
FIG. 6 is a circuit diagram showing a modification of the constant current source circuit according to the present invention.

Referring now to FIG. 6, there is shown in the circuit diagram another constant current source circuit according to the present invention. In FIG. 6, first and second NPN transistors 40 and 42 are connected to form current mirror circuit 44. Third and fourth PNP transistors 50 and 54 are connected to form current mirror circuit 52. Transistor 40 is connected at its emitter to reference potential source GND and at its collector to power source $V_{cc}$ via resistor 46 and fifth PNP transistor 48 in series. Transistor 40 is itself connected as a diode through resistor 46 by connecting the base between transistor 48 and resistor 46. Transistor 42 in current mirror circuit 44 is connected at its emitter to reference potential source GND and at its collector to power source $V_{cc}$ via PNP transistor 50. Transistor 48 is connected at its base to the collector of transistor 50. PNP transistor 54 is connected in a diode fashion. Transistor 54 is connected at its emitter to power source $V_{cc}$ and at its collector to reference potential source GND via sixth NPN transistor 56 whose base is connected to the collector of transistor 48. It is assumed that transistor 48 has an emitter of unit area and transistors 40, 42, 50, 54 and 56 have base-emitter junction areas respectively of $N_{40}$, $N_{42}$, $N_{50}$, $N_{54}$ and $N_{56}$ times the unit area. The base-emitter junction area ratios $N_{40}$, $N_{42}$, $N_{50}$, $N_{54}$ and $N_{56}$ are not necessarily integers.

As easily understood from a comparison with FIG. 3, the circuit of FIG. 6 is equivalent to that of FIG. 3 except for certain circuit connections for transistors 40 and 42. In FIG. 6, the base of transistor 40 is connected to its collector through resistor 46, as compared to FIG. 3 where the base of transistor 40 is connected directly to its collector. In FIG. 6 the base of transistor 42 is connected to the collector of transistor 40, but in FIG. 3 the base of transistor 42 is connected to the base of transistor 40. The operation of the circuit, with regard to transistors 40 and 42 in FIG. 6, will be explained in detail, it being understood that the operation of the remainder of the circuit is similar to that of the FIG. 3 circuit.

When the current $I_{40}$ varies, there will be a variation of voltage drop $V_{46}$ across resistor 46 and the base potentials of transistors 42 and 56 will vary in accordance with the variation of current $I_{40}$. Transistors 42 and 56 make a negative feedback loop in cooperation with current mirror 52 and transistor 48 to stabilize the potential at the connecting point of resistor 46 and transistor 48. The potential at the connecting point, that is, the sum of the voltage drop $V_{46}$ and the base-to-emitter voltage $V_{BE}$ of transistor 40, is applied to the base of transistor 56. The variation of current $I_{40}$ is detected by transistors 42 and 56. Transistors 42 and 56 vary their currents $I_{42}$ and $I_{56}$ according to variations of their respective base potentials. The variations of the base potentials of transistors 42 and 56 are fed back to resistor 46 through the above mentioned negative feedback loop. Therefore, the circuit of FIG. 6 is automatically controlled to maintain the operation currents of the respective transistors 40, 42, 48, 50, 54 and 56 at their predetermined values, in particular, current $I_{40}$ is held at the value $I_o$.

If it is assumed that transistors 40, 42, 50, 54 and 56 have base-emitter junctions respectively of $N_{40}$, $N_{42}$, $N_{50}$, $N_{54}$ and $N_{56}$ times the unit area, where the base-emitter junction area ratios $N_{40}$, $N_{42}$, $N_{50}$, $N_{54}$ $N_{56}$ are not necessarily integers, certain relationships of the operation currents $I_{40}$, $I_{42}$, $I_{48}$, $I_{50}$, $I_{54}$ and $I_{56}$ are established. Since transistor 48 is connected in series to transistor 40, $$I_{48}=I_{40}=I$$

With regard to currents $I_{40}$ and $I_{42}$, $$R_{46}\times I+V_T\times 1n(I_{42}/(N_{42}\times I_{S(NPN)}))=V_T\times 1n(I_{40}/(N_{40}\times I_{S(NPN)}))$$

Therefore, $$I=(V_T/R_{46})\times 1n(N_{42}\times I_{40})/(N_{40}\times I_{42})=(V_T/R_{46})\times 1n(N_{42}\times I)/(N_{40}\times I_{42}) \quad (6)$$

With regard to currents $I_{40}$ and $I_{56}$, $$I_{56}=(N_{56}/N_{40})\times I_{40}=(N_{56}/N_{40})\times I \quad (7)$$

With regard to currents $I_{54}$ and $I_{50}$, $$I_{50}=(N_{50}/N_{54})\times I_{54}=(N_{50}/N_{54})=I_{56} \quad (8)$$ because, $$I_{56}=I_{54}$$

By substituting equation (7) into equation (8), $$I_{40}=(N_{50}/N_{54})\times(N_{56}/N_{40})\times I \quad (9)$$

By substituting equation (9)into equation (6) since current $I_{42}$ is balancing to $I_{50}$, $$I=(V_T/R_{46})\times \ln(N_{42}\times I)/(N_{40}\times(N_{50}/N_{54})\times(N_{56}/N_{40})\times I) \quad (10)$$

$$=(V_T/R_{46})\times \ln(N_{42}\times N_{54})/(N_{56}\times N_{50})$$

As is apparent from equation (10), current I has no connection with the ratio $N_{40}$ of transistor 40. Further, current I is equivalent to current I of the circuit shown in FIG. 3.

The circuit shown in FIG. 6 also has only two transistors at the most in series in any path between power source $V_{cc}$ and reference potential source GND. Therefore, the constant current source circuit shown in FIG. 6 is also able to operate at a relatively low power source voltage compared to that shown in FIG. 2. Other features of the circuit shown in FIG. 3 are also adapted to the circuit of FIG. 6.

It should be understood, of course, that the foregoing disclosure relates to the preferred embodiments of the invention and that numerous modifications may be made without departing from the spirit and scope of the present invention as set forth in the following claims. For instance, the conductivity types of the respective transistors can be reversed and still achieve the same results.

What is claimed is:

1. A constant current source circuit adapted to be connected to a voltage source comprising:

first and second transistor devices of a first conductivity type, each having an emitter, base, and collector; said respective emitters being coupled to each other, said respective bases being connected to each other, and said collector of said first transistor device being connected to said respective bases;

third and fourth transistor devices of a second conductivity type, each having an emitter, base, and collector; said respective emitters being coupled to each other, said respective bases being connected to each other, and said collector of said fourth transistor device being connected to said respective bases, the collectors of said second and third transistor devices being connected;

current supplying means connected in series with said first transistor;

resistance means connected between said current supplying means and said first transistor; and means for detecting the voltage potential at the connection point between said current supplying means and said resistor and for controlling the current through said first transistor at a constant level by a feedback loop through said fourth and third transistors and said current supplying means.

2. The constant current source circuit according to claim 1, wherein said current supplying means is a fifth transistor device of the second conductvity type whose base electrode is connected to the connection point between said second and third transistor devices.

3. A constant current source circuit according to claim 1, wherein said potential detecting means is a sixth transistor device of the first conductivity type whose base is connected to the connection point between said current supplying means and said resistance means.

4. The constant current source circuit according to claim 3, wherein said current supplying means is said fifth transistor device.

5. The constant current source circuit according to claim 3, wherein base-emitter junction areas of said second, third, fourth and sixth transistor devices have predetermined ratios among them.

6. The constant current source circuit according to claim 1, wherein said collector electrode of said first transistor device is connected to its base electrode through said resistor means.

7. The constant current source circuit according to claim 6, wherein said current supplying means is a fifth transistor device of the second conductivity type whose base is connected to the connection point between said second and third transistor devices.

8. The constant current source circuit according to claim 7, wherein said potential detecting means is a sixth transistor device of the first conductivity type whose base is connected to the connection point between said fifth transistor device and said resistor means.

9. The constant current source circuit according to claim 8, wherein base-emitter junction areas of said second, third, fourth and sixth transistor devices have predetermined ratios among them.

10. A constant current source circuit adapted to be connected to a voltage source comprising:

first and second transistor devices of first conductivity type connected to form a first current mirror circuit, said first transistor device being connected as a diode;

third and fourth transistor devices of second conductivity type, connected to form a second current mirror circuit, said third transistor device being connected in series with said second transistor device, and said fourth transistor device being connected as a diode;

a fifth transistor device connected at its collector-emitter path in series with said first transistor device and at its base to the connection point between said second and third transistor devices;

resistance means connected between said first and fifth transistor devices; and a sixth transistor device connected at its collector-emitter path in series with said fourth transistor device and at its base electrode to the connection point between said fifth transistor device and said resistor means for controlling the current output of said first current mirror at a constant level regardless of variations in the voltage level of said voltage source responsive to the voltage potential at said connection point.

11. The constant current source circuit according to claim 10, wherein the base electrode of said first transistor device is directly connected to its collector electrode.

12. The constant current source circuit according to claim 10, wherein the base electrode of said first transistor device is connected to its collector electrode through said resistor means.

* * * * *